US005188926A

United States Patent [19]

Schofield et al.

[11] Patent Number: 5,188,926

[45] Date of Patent: Feb. 23, 1993

[54] PHOTOGRAPHIC ELEMENTS HAVING CARBONAMIDE COUPLER SOLVENTS AND ADDENDA TO REDUCE SENSITIZING DYE STAIN

[75] Inventors: Edward Schofield, Penfield; Paul B. Merkel, Rochester; Tienteh Chen, Penfield, all of N.Y.

[73] Assignee: Eastman Kodak Company, Rochester, N.Y.

[21] Appl. No.: 805,880

[22] Filed: Dec. 9, 1991

[51] Int. Cl.[5] ..... G03C 7/30; G03C 7/388

[52] U.S. Cl. ..... 430/377; 430/377; 430/546; 430/384; 430/385; 430/388; 430/389

[58] Field of Search ..... 430/377, 546, 553, 384, 430/385, 388, 389, 559, 560

[56] References Cited

U.S. PATENT DOCUMENTS

| | | | |
|---|---|---|---|
| 2,322,027 | 6/1943 | Jelley et al. . | |
| 2,759,821 | 8/1956 | Jones et al. . | |
| 3,764,336 | 10/1973 | Nittel et al. . | |
| 4,203,767 | 5/1980 | Fujiwhara et al. | 430/376 |
| 4,250,251 | 2/1981 | Osborn et al. | 430/449 |
| 4,419,439 | 12/1983 | Kuwazima et al. | 430/375 |
| 4,557,999 | 12/1985 | Aoki et al. | 430/385 |
| 4,745,049 | 5/1988 | Ohbayashi et al. | 430/546 |
| 4,840,878 | 6/1989 | Hirose et al. | 430/380 |
| 4,857,449 | 8/1989 | Ogawa et al. | 430/546 |
| 5,019,490 | 5/1991 | Kobayashi et al. | 430/546 |

*Primary Examiner*—Charles L. Bowers, Jr.
*Assistant Examiner*—Mark F. Huff
*Attorney, Agent, or Firm*—Foley & Lardner

[57] ABSTRACT

A method of forming color in a silver halide photographic element wherein the silver halide is sensitized with a dye involves reacting an oxidized developing agent with a phenol or naphthol cyan dye-forming coupler or an acylacetamide yellow dye-forming coupler in a carbonamide coupler solvent. The carbonamide solvent reduces sensitizer dye staining with the cyan or yellow dye-forming coupler in processed photographic materials (films and papers) due to retained sensitizing dye.

25 Claims, No Drawings

PHOTOGRAPHIC ELEMENTS HAVING CARBONAMIDE COUPLER SOLVENTS AND ADDENDA TO REDUCE SENSITIZING DYE STAIN

TECHNICAL FIELD

This invention relates to coupler compositions used in silver halide photographic films, particularly to color photographic films which utilize carbonamide coupler solvents or addenda in combination with sensitizing dyes.

BACKGROUND ART

Processed photographic films and papers which utilize a coupler and a sensitizing dye tend to retain the sensitizing dye, resulting in staining. This staining tends to be particularly severe with couplers that contain phenol groups or other strong hydrogen bond donor groups. High levels of staining can result in processed papers and reversal films which are visually objectionable, and in negative films with inferior printing characteristics. Consequently, the need exists to identify compositions and methods to reduce retained sensitizing dye and the associated stain.

Carbonamides represent one known class of high-boiling coupler solvents used in photographic materials. U.S. Pat. No. 4,840,878 mentions carbonamides among other possible solvents that may be used in materials coated on a reflective support and processed with a short (≦2½ minute) development time. U.S. Pat. No. 4,745,049 discloses the use of certain aryloxy substituted carbonamides in combination with yellow couplers for improved dye light stability. German Patent DD 225,240 Al describes the use of similar aryloxy substituted oarbonamides with various types of oouplers. U.S. Pat. No. 3,764,336 discloses the use of carboxy-substituted carbonamides in the preparation of coupler dispersions. U.S. Pat. No. 4,857,449 notes that carbonamide coupler solvents, among many other types, may be used in combination with a wide variety of water-insoluble polymeric materials. U.S. Pat. Nos. 4,250,251 and 4,419,439 disclose the use of carbonamides among other coupler solvents in combination with specific naphthol couplers. U.S. Pat. No. 4,557,999 mentions the use of carbonamides, among other coupler solvents, with non-uredo 76-class couplers See also U.S. Pat. Nos. 2,322,027, 2,759,821, and Japanese Patent Application No. 54/4125. U.S. Pat. No. 4,203,767 discloses use of coupler solvents, such as carbonamides, with Kodachrome couplers.

U.S. Pat. No. 5,028,519 discloses the use of certain heterocyclic nitrogen compounds with yellow and cyan couplers for improved stability.

The combination of certain pyrazolone magenta dye-forming couplers with carbonamides is disclosed in German Patent Application 3,730,577 Al. Carbonamides in combination with 218-class couplers are disclosed in U.S Pat. No. 4,900,655. U.S. Pat. No. 4,865,963 discloses carbonamides in combination with a subclass of 224 couplers.

Despite the broad use of various carbonamides in connection with couplers, no reference is made to additional specific coupler solvent-coupler combinations which significantly reduce staining by residual sensitizing dye.

DISCLOSURE OF INVENTION

The invention provides a method of forming color in a silver halide photographic element wherein the silver halide is sensitized with a dye. An oxidized developing agent is reacted with a cyan or yellow dye-forming coupler in a carbonamide coupler solvent. When the cyan or yellow dye-forming coupler is used, the carbonamide solvent reduces sensitizer dye staining in processed photographic materials (films and papers) due to retained sensitizing dye.

A coupler composition according to the invention, which may be employed in a developer or as part of a photosensitive element, preferably comprises a phenol or naphthol cyan dye-forming coupler, or an acylacetamide yellow dye-forming coupler, in a solvent comprising a carbonamide, alone or in combination with one or more organic cosolvents. Such a composition can be used to make a photosensitive element comprising a layer of a silver halide photosensitive emulsion disposed on a support in combination with a dye-forming coupler. As is well known, the coupler reacts with an oxidized developing agent such as a p-phenylenediamine derivative to form a colored image which corresponds to a pattern of exposure of the silver halide. According to the invention, the silver halide is sensitized with a dye, and the photosensitive layer contains a phenolic, naphtholic or acylacetamide coupler in a carbonamide solvent effective for reducing staining caused by the dye.

MODES FOR CARRYING OUT THE INVENTION

The photographic composition of the present invention comprises a high-boiling, ballasted carbonamide compound (coupler solvent) in combination with specific yellow dye-forming or cyan dye-forming couplers. For purposes of the invention, "ballast" refers to carbonamide compounds substituted with organic substituents totalling at least 10 carbon atoms. Combinations of coupler solvents and couplers according to the invention provide the advantage of reduced post-process stain due to reduction in retained sensitizing dye. The photographic composition of the invention can also be used in combination with polymeric addenda, as described below.

Preferred ballasted carbonamide compounds for use in the invention are of formula I:

$$R_1\overset{\overset{\displaystyle O}{\|}}{C}NR_2R_3$$

wherein $R_1$, $R_2$ and $R_3$ are individually selected from the group consisting of straight and branched chain alkyl groups, alkenyl groups and alkylene groups, any of which may be substituted with one or more substituents selected from the group consisting of alkoxy, aryl, alkoxycarbonyl, aryloxycarbonyl and acyloxy; a phenyl group; and a phenyl group containing at least one substituent selected from the group consisting of alkyl, alkoxy, aryl, alkoxycarbonyl, aryloxycarbonyl, and acyloxy, and wherein $R_1$, $R_2$ and $R_3$ combined contain at least 12 carbon atoms, preferably 15–30 carbon atoms to minimize volatility, water solubility and diffusivity. $R_1$ and $R_2$ may join to form a ring, when R3 is an unsubstituted straight or branched chain alkyl, alkenyl or alkylene group. For example, $R_1$ and $R_2$ may join to form a five-membered pyrolidinone ring.

The carbonamide compound employed in the coupler compositions of the invention may act as a solvent for the dye-forming coupler. One or more additional organic (and preferably non-volatile, high boiling) solvents for the coupler compound may also be employed in the compositions of the invention. Generally, conventional organic coupler solvents such as those described in *Research Disclosure*, December, 1989, Item 308119, page 993, are known in the art and may be employed when the carbonamide compound of the invention is used in an additive amount which is not sufficient to result in a solution of the coupler compound. Illustrative organic solvents are described in the examples below.

The carbonamide compound is employed in the coupler compositions of the invention in an amount sufficient to reduce sensitizing dye stain. In most applications, it is preferred that the dye-forming coupler and the carbonamide compound are employed in a weight ratio of from about 1:0.1 to about 1:10. A preferred coupler coating composition according to the invention may contain weight ratios of coupler to carbonamide of from 1:0.2 to 1:5 and of carbonamide to optional coupler solvent of from 1:0 to 1:5.

Suitable carbonamide compounds useful in the practice of this invention include, but are not limited to, the following:

A-I $$n\text{-}C_{11}H_{23}\overset{O}{\overset{\|}{C}}N(C_2H_5)_2$$

A-II $$n\text{-}C_{11}H_{23}\overset{O}{\overset{\|}{C}}N(C_3H_7\text{-}n)_2$$

A-III $$n\text{-}C_{13}H_{27}\overset{O}{\overset{\|}{C}}N(CH_3)_2$$

A-IV $$n\text{-}C_8H_{17}CH{=}CH(CH_2)_7\overset{O}{\overset{\|}{C}}N(CH_3)_2$$

A-V $$n\text{-}C_{11}H_{23}\overset{O}{\overset{\|}{C}}N(C_4H_9\text{-}n)_2$$

A-VI

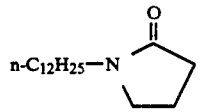

A-VII

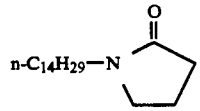

A-VIII

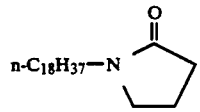

A-IX

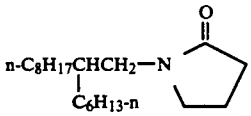

-continued

A-X

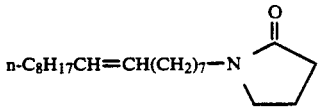

A-XI $$(n\text{-}C_6H_{13})_2N\overset{O}{\overset{\|}{C}}CH_2CH_2\overset{O}{\overset{\|}{C}}N(C_6H_{13}\text{-}n)_2$$

A-XII $$(n\text{-}C_5H_{12})_2N\overset{O}{\overset{\|}{C}}CH_2CH_2\overset{O}{\overset{\|}{C}}N(C_5H_{12}\text{-}n)_2$$

A-XIII

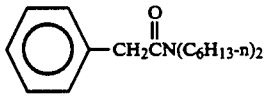

A-XIV

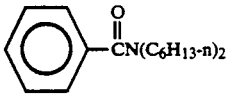

A-XV

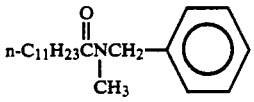

A-XVI

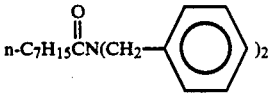

A-XVII

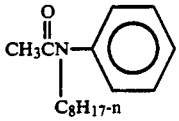

A-XVIII $$n\text{-}C_{15}H_{31}\overset{O}{\overset{\|}{C}}N(C_2H_5)_2$$

A-XIX

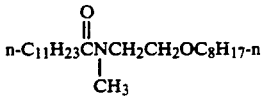

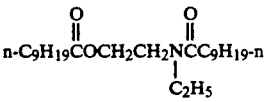

Couplers which form cyan dyes upon reaction with oxidized color developing agents are well known in the art and are described in such representative patents and publications as: U.S. Pat. Nos. 2,772,162; 3,476,563; 4,526,864; 4,500,635; 4,254,212; 4,296,200; 4,457,559; 2,895,826; 3,002,836; 3,034,892; 2,474,293; 2,801,171; 2,423,730; 2,367,531; 3,041,236; 4,443,536; 4,333,999; 4,124,396; 4,775,616; 3,779,763; 3,772,002; 3,419,390; 4,690,889; 3,996253 and "Farbkuppler-eine Literatureü bersicht," published in Agfa Mitteinlungen, Band III, pp. 156–175 (1961), the disclosures of which are incorporated herein by reference. In the preferred embodiment, the cyan dye-forming coupler comprises a phenol or naphthol compound which forms a cyan dye on reaction with an oxidized color developing agent. For example, the cyan dye-forming coupler may be a compound selected from the following formulae:

C-A

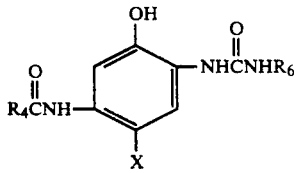

C-B

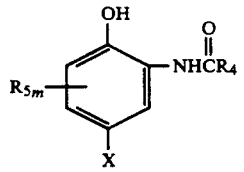

C-C

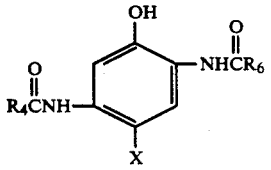

C-D

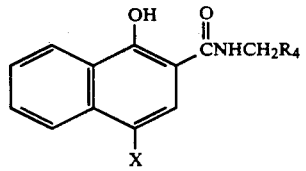

wherein $R_4$ is a ballast substituent having at least 10 oarbon atoms or is a group which links to a polymer forming a so-called polymeric coupler. Ballast substituents include alkyl, substituted alkyl, aryl and substituted aryl groups. Each $R_5$ is individually selected from hydrogen, halogens (e.g., chloro, fluoro), alkyl groups of 1 to 4 carbon atoms and alkoxy groups of 1 to 4 carbon atoms, and m is from 1 to 3. $R_6$ is selected from the group consisting of substituted and unsubstituted alkyl and aryl groups wherein the substituents comprise one or more electron-withdrawing substituents, for example, cyano, halogen, methylsulfonyl or trifluoromethyl.

X is hydrogen or a coupling-off group. Coupling-off groups are well known to those skilled in the photographic art. Generally, such groups determine the equivalency of the coupler and modify the reactivity of the coupler. Coupling-off groups can also advantageously affect the layer in which the coupler is coated or other layers in the photographic material by performing, after release from the coupler, such functions as development inhibition, bleach acceleration, color correction, development acceleration and the like. Representative coupling-off groups include halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in U.S. Pat. Nos. 2,355,169; 3,227,551; 3,432,521; 3,476,563; 3,617,291; 3,880,661; 4,052,212 and 4,134,766, and in British Patent Nos. 1,466,728; 1,531,927; 1,533,039; 2,006,755A and 2,017,704A, the disclosures of which are incorporated herein by reference.

A coupler compound should be nondiffusable when incorporated in a photographic element. That is, the coupler compound should be of such a molecular size and configuration that it will exhibit substantially no diffusion from the layer in which it is coated. In order to ensure that the coupler compound is nondiffusable, the substituent $R_4$ should contain at least 10 carbon atoms or should be a group which is linked to or forms part of a polymer chain.

Couplers which form yellow dyes upon reaction with an oxidized color developing agent are described in such representative patents and publications as: U.S. Pat. Nos. 3,384,657; 3,415,652; 3,542,840; 4,046,575; 3,894,875; 4,095,983; 4,182,630; 2,875,057; 2,407,210; 3,265,506; 2,298,443; 3,408,194; 3,447,928; 4,587,207; 4,617,256; 4,587,205; 4,529,691; 4,443,536; 4,326,024; 4,203,768; 4,221,860; 3,933,501; 4,022,620; 4,401,752; European Patent Application 296,793 and "Farbkuppler-eine Literaturübersicht," published in Agfa Mitteilungen, Band III, pp. 112–126 (1961). Preferably, such yellow-dye forming couplers are acylacetamides, such as benzoylacetanilides (Y-A) and pivaloylacetanilides (Y-B):

(Y-A)

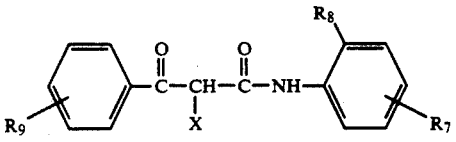

(Y-B)

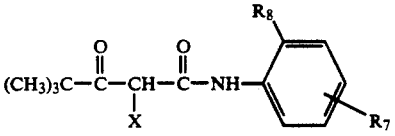

wherein $R_7$ is a ballast group having at least 10 carbon atoms, or may be hydrogen or a halogen if R8 or $R_9$ contains sufficient ballast (10 carbon atoms), or may be a group which links to a polymer. R8 may be hydrogen, halogen (e.g., a chlorine atom), an alkyl group, an alkoxy group or an aryloxy group. $R_9$ may be hydrogen, or one or more halogen (e.g., chlorine), alkyl or alkoxy groups or a ballast group. X is as defined above for cyan couplers. Ballast groups suitable for $R_7$ or $R_9$ include, for example, acyloxy groups, alkoxycarbonyl groups, aryloxycarbonyl groups, carbonamide groups, carbamoyl groups, sulfonamide groups, and sulfamoyl groups which may themselves be substituted.

Specific examples of cyan dye-forming couplers useful for the practice of this invention include, but are not limited to, compounds c-i to c-x below, which represent species based on generic formulas C-A to C-D above:

(c-i)
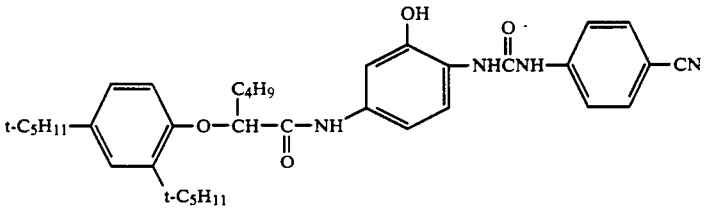
(c-ii)
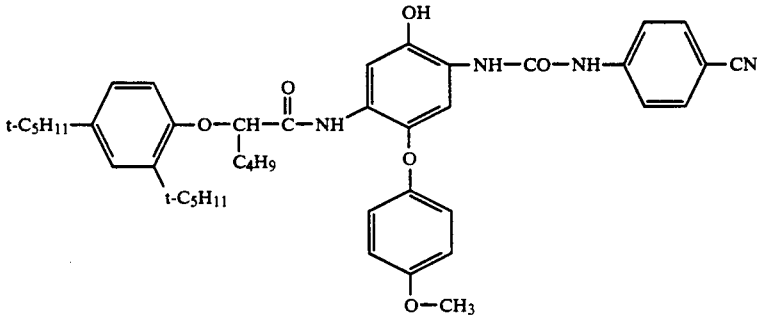
(c-iii)
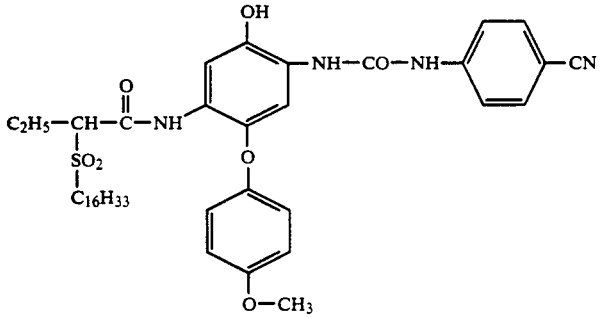
(c-iv)
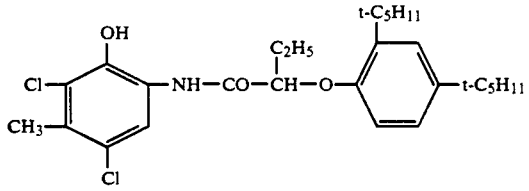
(c-v)
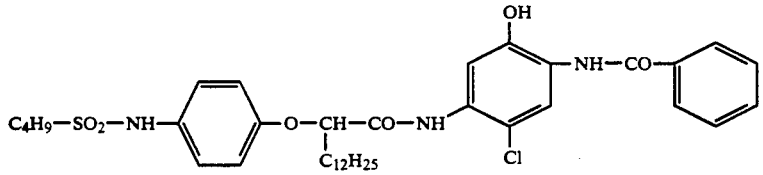
(c-vi)
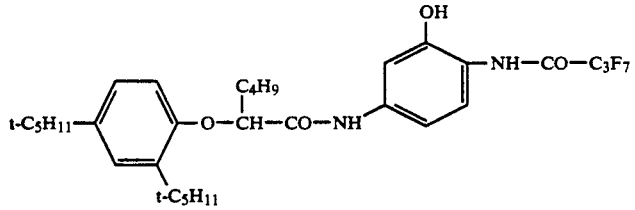
(c-vii)
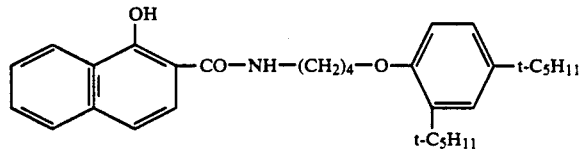

-continued
(c-viii)
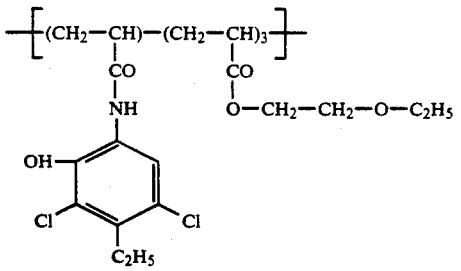
(c-ix)
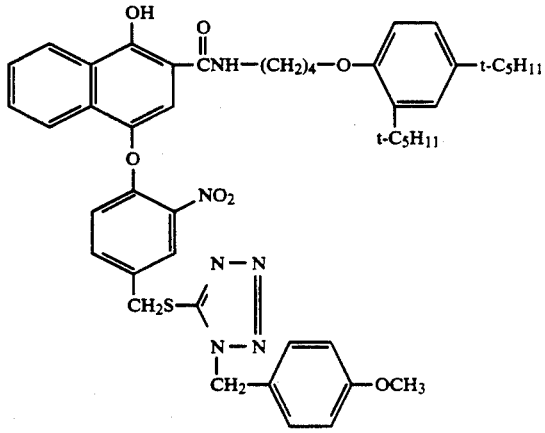
(c-x)
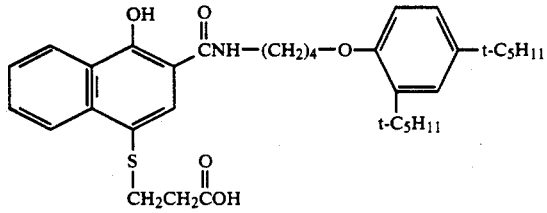
Specific examples of yellow dye-forming couplers useful for the practice of this invention include, but are not limited to compounds y-i to y-x below, which represent species based on generic formulas Y-A and Y-B above:
(y-i)
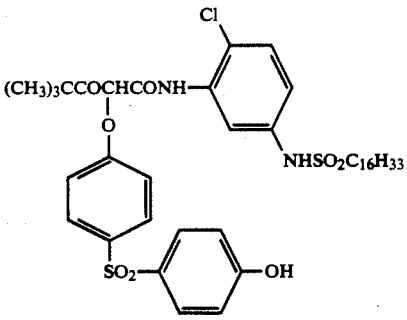
(y-ii)
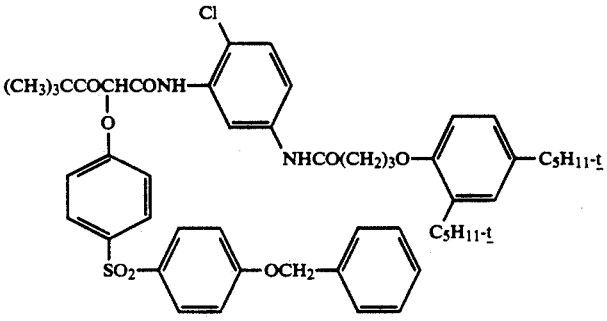

-continued
(y-iii)
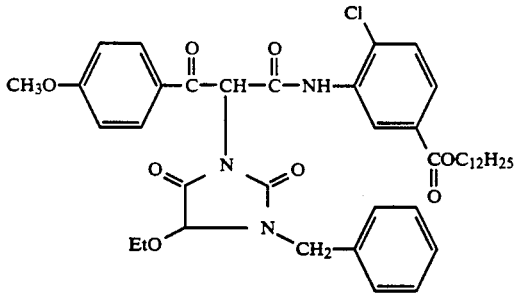
(y-iv)
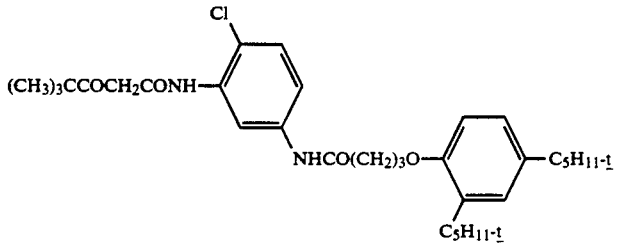
(y-v)
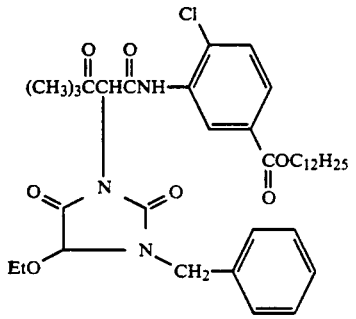
(y-vi)
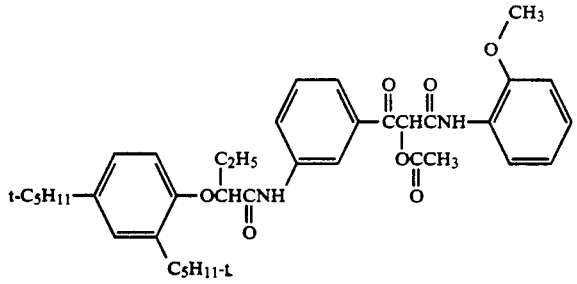
(y-vii)
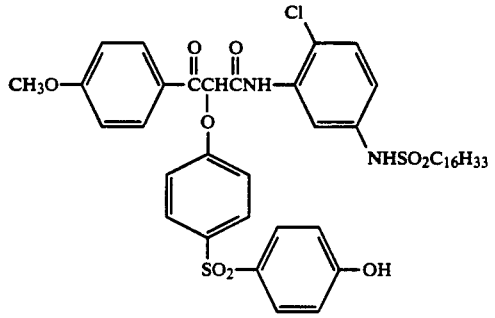

-continued (y-viii)

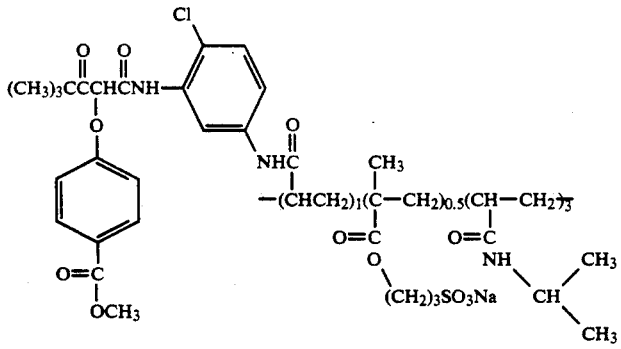

(y-ix)

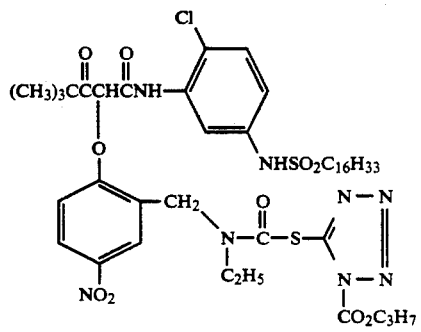

(y-x)

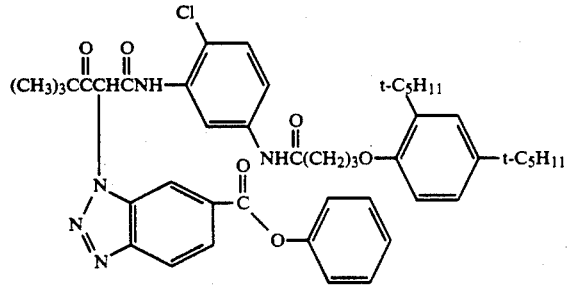

The spectral sensitizer used in a photosensitive element according to the invention depends on the desired color and structure of the element, e.g., the number of layers. Sensitizing dyes useful in the practice of the invention include those types noted in *Research Disclosure,* December 1989, Item 308119, p.933. Anionic sensitizing dyes, particularly heterocyclic mercapto compounds having anionic sulfonate groups, are preferred, insofar as staining has been a problem with such dyes.

Silver halide emulsions of the invention can also be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* cited above, Item 17643, Section IV.

The carbonamide compound may also be used in combination with polymeric addenda. With respect to the use of carbonamides in combination with polymers, Example 2 below demonstrates that further reduction in retained sensitizing dye can be obtained by using polymeric addenda and carbonamide coupler solvents in combination. The polymer preferably is incorporated in the element in the same layer as the silver halide emulsion. It can be present in an amount that will vary depending upon the particular effect desired.

Polymers useful for the practice of this invention are disclosed in commonly-assigned U.S. patent application Ser. No. 07/691,576, filed Apr. 25, 1991, a continuation-in-part of U.S. patent application Ser. No. 07/531,827, filed Jun. 1, 1990, by inventors Edward Schofield and Tien-The Chen, the entire contents of both applications being incorporated herein by reference. Such a copolymer for incorporation into a spectrally sensitized silver halide color photographic element comprises (a) repeating units derived from a methoxy-or ethoxy-containing acrylate or acrylamide monomer, copolymerized with (b) a different methoxy-or ethoxy-containing acrylate monomer represented by the structure:

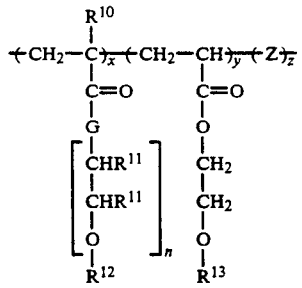

wherein

Z is the residue of one or more vinyl monomers,

G is —O—or —NH—, $R^{10}$ is —H or —$CH_3$, $R^{11}$ is —H or —$CH_3$, no more than one $R^{11}$ being —$CH_3$, $R^{12}$ and $R^{13}$ are —$CH_3$ or —$C_2H_5$, x is 15 to 90 weight percent, y is 0 to 90 weight percent, z is 0 to 85 weight percent, and n is 1 to 20, but if y=0, z must be -10.

In a preferred embodiment, the repeating units represented by Z are derived from one or more acid- or salt-containing vinyl monomers. In particular, one of $R^{12}$ and $R^{13}$ is methyl and the other is ethyl.

Examples of monomers useful in preparing polymers of this invention are methoxyethylacrylate or methacrylate, ethoxyethylacrylate or methacrylate, methoxyethoxyethyl-acrylate or methacrylate, methoxyethylacrylamide or methacrylamide, ethoxyethylacrylamide or methacrylamide, butyl acrylate, acrylic acid, methacrylic acid, hydroxyethylmethacrylate, hydroxyethylmethacrylamide, 2-methyl-2-[(1)-oxo-2-propenyl-)amino]-1-propane sulfonic acid, or its alkali metal salt, polypropyleneglycol monomethacrylate, polypropylene glycol monomethacrylamide. The polypropylene glycol monomers contain from 1 to 20 glycol units. The copolymers useful in the invention are free of repeating units containing dye-forming coupler moieties.

Copolymers containing methoxyethylacrylate, methoxyethylacrylamide or methacrylamide are especially preferred. Highly preferred polymers useful in this invention can be represented by the structure:

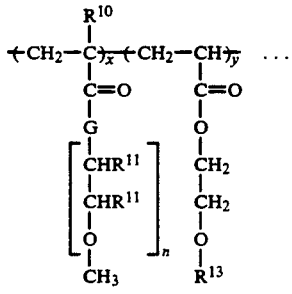

-continued

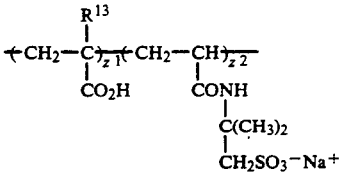

wherein

G, $R^{10}$, $R^{11}$ and $R^{13}$ are as defined above, x is 35 to 85 weight percent, y is 10 to 60 weight percent, $z^1$ is 3 to 10 weight percent, $z^2$ is 2 to 5 weight percent, and n is 1 to 20.

These polymers can be prepared by known polymerization processes, such as emulsion and solution polymerization, using known starting materials. Polymers prepared by emulsion polymerization can be mixed with gelatin and coated directly. Polymers prepared by solution polymerization can be dispersed in two different ways. The first way is to disperse the polymer in the same way that a ballasted coupler is dispersed, with or without a coupler solvent. The thus-formed dispersion is mixed with gelatin and coated. The second way is to disperse the polymer directly into water if enough units derived from ionizable monomers are present. The dispersion obtained is then mixed with gelatin and coated.

A photographic element of the invention generally comprises at least one layer containing a conventional silver halide photosensitive emulsion such as AgCl, AgBr, AgI, AgBrI or the like, in combination with a dye-forming coupler. The photographic coupler plus carbonamide compositions of the invention are employed in color photographic materials in a manner well known in the photographic art. For example, a supporting substrate, preferably transparent, may be coated with a silver halide emulsion and a coupler plus carbonamide composition of the invention. The photographic material may then be imagewise exposed and then developed in a solution containing a primary aromatic amine color developing agent. As further known in the art, the primary aromatic amine developing agent is oxidized in an imagewise manner by reaction with exposed silver halide grains, and the oxidized developer reacts with coupler to form dye. The development step is followed by bleaching and fixing steps or a bleach-fix step to remove silver and silver halide from the coating.

Additional couplers and/or addenda may be coated in the same layer as the couplers and carbonamides of this invention. Couplers likely to be used in combination with the couplers of this invention include inhibitor releasing couplers, commonly referred to as DIR couplers, and switched or timed inhibitor releasing couplers, referred to as DIAR couplers, such as those described in U.S. Pat. Nos. 3,148,062, 3,227,554, 3,733,201, 4,409,323 and 4,248,962. The couplers of this invention may also be used in combination with so-called masking couplers or with bleach accelerator releasing couplers (BARCs) as further described below and in Item 308119 in *Research Disclosure*, December 1989, page 993.

Photographic materials in which the coupler plus carbonamide compositions of this invention are incorporated may be simple elements or multilayer, multicolor elements. Multicolor elements contain dye image-forming units sensitive to each of the primary regions of the spectrum. Each unit can be comprised of a single emulsion layer or of multiple emulsion layers sensitive to a given region of the spectrum. The layers of the element and the layers of the unit can be arranged in various orders, as known in the art. The coupler plus carbonamide compositions of this invention may be coated on a transparent support or a reflective support, such as a paper support, and may be used in color negative, reversal or color print materials.

A typical multicolor photographic element of the invention comprises a support bearing a cyan dye image-forming unit comprising at least one red-sensitive silver halide emulsion layer having associated therewith a least one cyan dye-forming coupler, a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at lest one yellow dye-forming coupler. The element can contain additional layers, such as filter layers, interlayers, overcoat layers, subbing layers, and the like. The element typically will have a total thickness (excluding the support) of from 5 to 30 microns.

In the following discussion of suitable materials for use in the elements of this invention, reference will be made to *Research Disclosure,* December 1978, Item 17643, and December 1989, Item No. 308119 published by Kenneth Mason Publications, Ltd., Dudley Annex, 12a North Street, Emsworth, Hampshire P010 7DQ, ENGLAND, the disclosures of which are incorporated herein by reference. The elements of the invention can comprise emulsions and addenda described in these publications and in publications referenced in these publications.

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,414,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB 1,027,146; JA 54/48,521; U.S. Pat. Nos. 4,379,837, 4,444,877; 4,665,012; 4,686,178; 4,565,778; 4,728,602; 4,668,614 and 4,636,461; and in EP 264,954. The silver halide emulsions can be either monodisperse or polydisperse as precipitated. The grain size distribution of the emulsions can be controlled by silver halide grain separation techniques or by blending silver halide emulsions of differing grain sizes. Sensitizing compounds, such as compounds of copper, thallium, lead, bismuth, cadmium and group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure,* Item 17643, cited above, Section III.

Suitable vehicles for the emulsions layers and other layers of elements of this invention are described in Research Disclosure Item 17643, Section IX and the publications cited therein. The photographic elements can be coated on a variety of supports as described in *Research Disclosure,* Section XVII and the references described therein.

In addition to the couplers described herein, the elements of this invention can include additional couplers as described in *Research Disclosure* Section VII, paragraphs D, E, F and G and the publications therein. These additional couplers can be incorporated as described in *Research Disclosure,* Section VII, paragraph C and the publications cited therein. The coupler combinations of this invention can be used with colored masking couplers as described in U.S. Pat. No. 4,883,746 or with couplers that release bleach accelerators as described in European Patent Application 193,389.

The photographic elements of this invention can contain brighteners (*Research Disclosure,* Section V), antifoggants and stabilizers (*Research Disclosure* Section VI), antistain agents and image dye stabilizer (*Research Disclosure* Section VII, paragraphs I and J), light absorbing and scattering materials (Section VIII), hardeners (Section XI), plasticizers and lubricants (Section XII), antistatic agents (Section XIII), matting agents (Sections XII and XVI) and development modifiers (Section XXI). Preferred light stabilizers include phenols, alkoxybenzene derivatives, anilines and oxyanilines.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)-ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxy-ethyl)-m-toluidine di-p-toluenesulfonic acid.

With negative-working silver halide, the processing step described above provides a negative image. The described elements are preferably processed in the known C-41 color process as described in, for example, the *British Journal of Photooraphy Annual of* 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image. Development is followed by the conventional steps of bleaching, fixing, or bleach-fixing, to remove silver or silver halide, washing, and drying.

The compositions and methods of the invention are demonstrated by the following examples in which references are to parts by weight unless otherwise specified. In these examples, S1 refers to the comparative conventional coupler solvent consisting of a mixture of tritolyl phosphates, S2 refers to the conventional coupler solvent dibutylphthalate and S3 refers to 1,4-cyclohexylene dimethylene bis(2-ethylhexanoate).

EXAMPLE 1

Dispersions of the cyan dye-forming coupler c-i were prepared in a series of coupler solvents as follows. An oil phase was prepared by warming a mixture of 2.0 g of coupler, 2.0 g of coupler solvent (i.e., 1:1) and 6.0 g of the auxiliary solvent cyclohexanone until dissolution was complete. This was added to an aqueous phase consisting of 19.2 g of 12.5% aqueous gelatin, 2.4 g of aqueous 10% ALKANOL XC TM and 8.4 g of water. The oil phase was dispersed by pouring this mixture through a colloid mill.

Coupler dispersions were then coated on acetate support at a laydown of $1.39\times10^{-4}$ moles/ft$^2$ (83.2 mg/ft$^2$) of c-i together with a dye-sensitized tabular grain silver bromoiodide emulsion (3% iodide) in the format shown below. The auxiliary solvent evaporated on coating. The resulting photosensitive layer had laydown amounts as follows:

| | |
|---|---|
| Gelatin | 300 mg/ft$^2$ |
| Coupler c-i | 83.2 mg/ft$^2$ |
| Coupler Solvent | 83.2 mg/ft$^2$ |
| Silver Halide Emulsion | 150 mg Ag/ft$^2$ |

A protective layer of gelatin (200 mg/ft$^2$) and a bis(-vinylsufonyl)methane hardener at 1.75% of total gelatin in the protective layer was then overcoated on the photosensitive layer. The silver halide emulsion used had been spectrally sensitized with dye A, shown below:

A

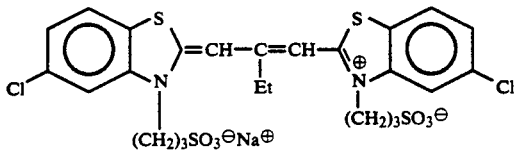

Film strips were exposed and subjected to the KODAK C41 FLEXACOLOR process (see citation above) under the following conditions:

| Solution | Time | Temp | Agitation |
|---|---|---|---|
| KF12 Developer | 3'15" | 100° F. | $N_2$ Burst |
| Flexicolor Bleach | 4' | " | Air |
| Wash | 3' | " | None |
| KF12 fix | 4' | " | $N_2$ |
| Wash | 4' | " | None |

Retained sensitizing dye in unexposed (Dmin) areas of film strips was extracted and analyzed by high perormance liquid chromatorgraphy (HPLC). The % dye remining in the film samples with various coupler solvents is listed in Table 1. The reduction in retained dye in carbonamide A-I relative to S1, S2 and S3 is evident.

TABLE 1

| Coupler Solvent | % Dye A Retained |
|---|---|
| S1 | 88.8 |
| S2 | 91.0 |
| S3 | 92.8 |
| A-I | 56.4 |

EXAMPLE 2

Dispersions of the cyan dye-forming coupler c-i were prepared in a series of coupler solvents and incorporated into the polymer B:

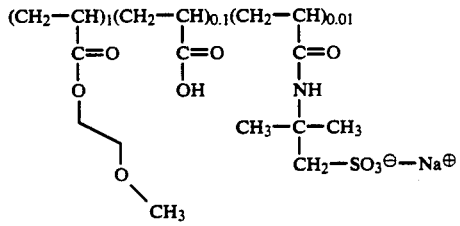

Coupler solvent dispersions were prepared by milling 3.0 g of coupler solvent and 1.1 g of ethyl acetate with 15 ml of 12.5% aqueous gelatin, 1.9 ml of 10% aqueous ALKANOL XC TM and 9.1 ml of water. The various coupler solvent dispersions were added to a mixture containing a c-i dispersion, latex polymer B, gelatin, spreading agent and tetraazaindine in quantities required to yield the coated levels as indicated below. The mixtures were stirred for three hours at 40° C. to achieve intermixing of the coupler, coupler solvent and polymer.

The silver halide emulsion sensitized with dye A referred to in Example 1 was added to the mixtures in the necessary amount prior to coating on an acetate support as in Example 1. The resulting n photosensitive layer had laydown amounts as follows:

| | |
|---|---|
| Gelatin | 300 mg/ft$^2$ |
| Coupler c-i | 83.2 mg/ft$^2$ |
| Coupler solvent | 83.2 mg/ft$^2$ |
| Polymer B | 41.5 mg/ft$^2$ |
| Silver Halide Emulsion | 150 mg Ag/ft$^2$ |

A protective layer of gelatin (200 mg/ft$^2$) and a bis(-vinylsufonyl)methane hardener at 1.75% of total gelatin in the protective layer was then overcoated on the photosensitive layer.

Film strips were exposed and processed (C-41), and retained sensitizing dye was analyzed as in the previous example. The data in Table 2 illustrates the reduction in retained sensitizing dye that is obtained by the combination of polymers such as B with carbonamide coupler solvents such as A-I.

TABLE 2

| Dispersion | % Dye A Retained |
|---|---|
| c-i + B (no additional solvent) | 16.0 |
| c-i + B + S1 | 4.8 |
| c-i + B + S2 | 8.2 |
| c-i + B + S3 | 6.1 |
| c-i + B + A-I | 3.9 |

EXAMPLE 3

In this example, dispersions of the yellow dye-forming coupler y-i were prepared in a series of coupler solvents in a manner similar to the procedure used in Example 1. In this case, ethyl acetate was used as the auxiliary solvent and the weight ratio of coupler to coupler solvent to ethyl acetate was 1:0.5:3. The dispersions of coupler y-i were coated at a coupler laydown of 150 mg/ft$^2$ (0.186 mmoles/ft$^2$), together with a 0.2 micron silver chloride emulsion sensitized with dye C:

C

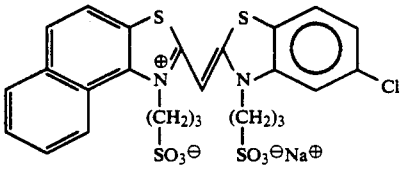

The resulting photosensitive layer had laydown amounts as follows:

| | |
|---|---|
| Gelatin | 350 mg/ft$^2$ |
| Coupler y-i | 150 mg/ft$^2$ |
| Coupler Solvent | 75 mg/ft$^2$ |
| Silver Halide Emulsion | 140 mg Ag/ft$^2$ |

A layer of gelatin (250 mg/ft$^2$) and a bis(vinylsufonyl) methane hardener in an amount of 1.85% of total gelatin was then overcoated on the photosensitive layer.

Film strips were exposed and processed as described in Example 1, and retained sensitizing dye was measured by HPLC analysis of film extracts. Table 3 lists reductions in sensitizing dye in unexposed (Dmin) areas of the films containing the various coupler solvents. More of the sensitizing dye was removed in the films containing carbonamides A-I, A-V, and A-VI than in the films containing the comparative coupler solvents S1, S2 or S3.

TABLE 3

| Coupler Solvent | Mg/ft$^2$ of Dye C Removed |
|---|---|
| S1 | 0.19 |
| S2 | 0.15 |
| S3 | 0.15 |
| A-I | 0.27 |
| A-V | 0.24 |
| A-VI | 0.37 |

It will be understood that the foregoing description is of preferred exemplary embodiments of the invention, and that the invention is not limited to the specific forms shown. Modifications may be made in the compositions of the invention without departing from the scope of the invention as expressed in the appended claims.

What is claimed is:

1. A method of forming color in a silver halide photographic element wherein the silver halide is sensitized with a dye, which comprises reacting an oxidized developing agent with a phenolic or naptholic cyan dye-forming coupler in a carbonamide coupler solvent having the formula:

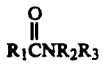

wherein $R_1$, $R_2$ and $R_3$ are individually selected from the group consisting of straight and branched chain alkyl groups, alkenyl groups and alkylene groups, any of which may be substituted with one or more substitutents selected from the group consisting of alkoxy, aryl, alkoxycarbonyl, aryloxycarbonyl and acyloxy; a phenyl group; and a phenyl group containing at least one substituent selected from the group consisting of alkyl, alkoxy, aryl, alkoxycarbonyl, aryloxcarbonyl and acyloxy, and wherein $R_1$, $R_2$ and $R_3$ combined have from 15 to 30 carbon atoms, and $R_1$ and $R_2$ may join to form a ring, when $R_3$ is an unsubstituted straight or branched chain alkyl, alkenyl or alkylene group, and the carbonamide coupler solvent is used in an amount effective to reduce sensitizer dye staining caused by residual dye retained after processing of the photographic element.

2. The method of claim 1, wherein $R_1$, $R_2$ and $R_3$ are selected from unsubstituted straight and branched chain alkyl groups, alkenyl groups and alkylene groups.

3. The method of claim 1, wherein the coupler and the carbonamide compound are employed in a weight ratio of from about 1:0.1 to about 1:10.

4. The method of claim 1, wherein the coupler is a cyan dye-forming coupler of the following formulae:

C-A

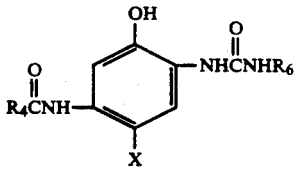

C-B

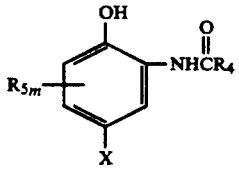

C-C

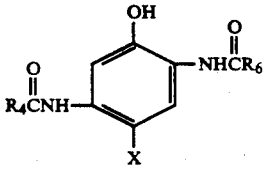

-continued

C-D

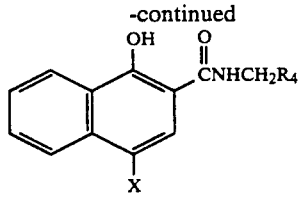

wherein m is from 1 to 3; $R_4$ is an alkyl, substituted alkyl, aryl and substituted aryl group having at least 10 carbon atoms, or a group which links to a organic polymer; each $R_5$ is individually selected from hydrogen, halogen, alkyl groups of 1 to 4 carbon atoms and alkoxy groups of 1 to 4 carbon atoms; $R_6$ is selected from substituted and unsubstituted alkyl and aryl groups, wherein the substituents comprise one or more electron-withdrawing substituents; and X is hydrogen or a substituted or unsubstituted coupling-off group selected from halogen, alkoxy, aryloxy, alkylthio, arylthio, acyloxy, sulfonamido, carbonamido, arylazo, nitrogen-containing heterocyclic groups, and imido groups.

5. The method of claim 4, wherein $R_6$ is an alkyl or aryl group substituted with one or more of cyano, halogen, methylsulfonyl or trifluoromethyl groups.

6. The method of claim 5, wherein X is hydrogen.

7. The method of claim 1, wherein the dye consists essentially of an anionic dye containing an anionic sulfonate group.

8. The method of claim 7, wherein the dye consists essentially of a heterocyclic mercapto compound.

9. A method of forming color in a silver halide photographic element wherein the silver halide is sensitized with a dye, which comprises reacting an oxidized developing agent with an acylacetamide yellow dye-forming coupler in a carbonamide coupler solvent having the formula:

$$R_1\overset{\overset{\displaystyle O}{\|}}{C}NR_2R_3$$

wherein $R_1$, $R_2$ and $R_3$ are individually selected from the group consisting of straight and branched chain alkyl groups, alkenyl groups and alkylene groups, any of which may be substituted with one or more substituents selected from the group consisting of alkoxy, aryl, alkoxycarbonyl, aryloxycarbonyl and acyloxy; a phenyl groups; and a phenyl group containing at least one substituent selected from the group consisting of alkyl, alkoxy, aryl, alkoxycarbonyl, aryloxcarbonyl and acyloxy, and wherein $R_1$, $R_2$ and $R_3$ combined have from 15 to 30 carbon atoms, and $R_1$ an $R_2$ may join to form a ring, when $R_3$ is an unsubsituted straight or branched chain alkyl, alkenyl or alkylene group, and the carbonamide coupler solvent is used in an amount effective to reduce sensitizer dye straining caused by residual dye retained after processing of the photographic element.

10. The method of claim 9, wherein $R_1$, $R_2$ and $R_3$ are selected from unsubstituted straight and branched chain alkyl groups, alkenyl groups and alkylene groups.

11. The method of claim 9, wherein the coupler and the carbonamide compound are employed in a weight ratio of from about 1:0.1 to about 1:10.

12. The method of claim 9, wherein the coupler is a yellow dye-forming coupler of the formula:

(Y-A)

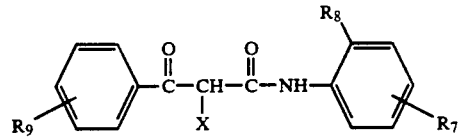

(Y-B)

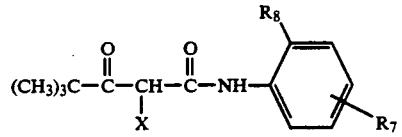

wherein $R_7$ is a ballast group having at least 10 carbon atoms, or may be hydrogen or a halogen if $R_8$ or $R_9$ contains has at least 10 carbon atoms, or may be a group which links to a polymer, $R_8$ may be hydrogen, halogen, an alkyl group, an alkoxy group or an aryloxy group, $R_9$ may be hydrogen, halogen, alkyl, alkoxy, or a ballast group having at least 10 carbon atoms, and X is hydrogen or a substituted or substituted coupling-off group selected from halogen, alkoxy, aryloxy, alkyl thio, aryl thio, acyloxy, sulfonamido, carbonamido, arylazo, nitrogen-containing heterocylic groups, and imido groups.

13. The method of claim 12, wherein ballast groups for $R_7$ or $R_9$, which may be the same or different, are selected from substituted or unsubsituted acyloxy, alkoxycarbonyl, aryloxycarbonyl, carbonamide, carbamoyl, sulfonamide, and sulfamoyl groups.

14. The method of claim 9, wherein the dye consists essentially of an anionic dye containing an anionic sulfonate group.

15. The method of claim 14, wherein the dye consists essentially of a heterocyclic mercapto compound.

16. In a photosensitive element comprising a layer of a silver halide photosensitive emulsion disposed on a support in combination with a dye-forming coupler which reacts with an oxidized developing agent to form a colored image which corresponds to a pattern of exposure of the silver halide, the improvement which comprises:

the silver halide is sensitized with a dye, and said photosensitive layer contains a phenolic or naphtholic cyan dye-forming coupler in a carbonamide solvent having the formula:

$$R_1\overset{\overset{\displaystyle O}{\|}}{C}NR_2R_3$$

wherein $R_1$, $R_2$ and $R_3$ are individually selected from the group consisting of straight and branched chain alkyl groups, alkenyl groups and alkylene groups, any of which may be substituted with one or more substitutents selected from the group consisting of alkoxy, aryl, alkoxycarbonyl, aryloxcarbonyl and acyloxy; a phenyl group; and a phenyl group containing at least one substituent selected from the group consisting of alkyl, alkoxy, aryl, alkoxycarbonyl, aryloxcarbonyl and acyloxy, and wherein $R_1$, $R_2$ and $R_3$ combined have from 15 to 30 carbon atoms, and $R_1$ and $R_2$ may join to form a ring, when $R_3$ is an unsubstituted straight or branched chain alkyl, alkenyl or alkylene group, and the carbonamide coupler solvent is used in an amount effective to reduce sensitizer dye staining caused by residual dye retained after processing of the photosensitive element.

17. The photosensitive element of claim 16, wherein $R_1$, $R_2$ and $R_3$ are selected from unsubstituted straight and branched chain alkyl groups, alkenyl groups and alkylene groups.

18. The photosensitive element of claim 16, wherein the coupler and the carbonamide compound are employed in a weight ratio of from about 1:0.1 to about 1.10.

19. The photosensitive element of claim 16, wherein the dye consists essentially of an anionic dye containing an anionic sulfonate group.

20. The photosensitive element of claim 19, wherein the dye consists essentially of a heterocyclic mercapto compound.

21. In a photosensitive element comprising a layer of a silver halide photosensitive emulsion disposed on a support in combination with a dye-forming coupler which reacts with an oxidized developing agent to form a colored image which corresponds to a pattern of exposure of the silver halide, the improvement which comprises:

the silver halide is sensitized with a dye, and said photosensitive layer contains a acylacetamide yellow dye-forming coupler in a carbonamide solvent having the formula:

$$R_1\overset{\overset{\displaystyle O}{\|}}{C}NR_2R_3$$

wherein $R_1$, $R_2$ and $R_3$ are individually selected from the group consisting of straight and branched chain alkyl groups, alkenyl groups and alkylene groups, any of which may be substituted with one or more substituents selected from the group consisting of alkoxy, aryl, alkoxycarbonyl, aryloxcarbonyl and acyloxy; a phenyl groups; and a phenyl group containing at least one substitutent selected from the group consisting of alkyl, alkoxy, aryl, alkoxycarbonyl, aryloxycarbonyl and acyloxy, and wherein $R_1$, $R_2$ and $R_3$ combined have from 15 to 30 carbon atoms, and $R_1$ an $R_2$ may joint to form a ring, when $R_3$ is an unsubstituted straight or branched chain alkyl, alkenyl or alkylene group, and the carbonamide coupler solvent is used in an amount effective to reduce sensitizer dye staining caused by residual dye retained after processing of the photosensitive element.

22. The photosensitive element of claim 21, wherein $R_1$, $R_2$ and $R_3$ are selected from unsubstituted straight and branched chain alkyl groups, alkenyl groups and alkylene groups.

23. The photosensitive element of claim 21, wherein the coupler and the carbonamide compound are employed in a weight ratio of from about 1:0.1 to about 1:10.

24. The photosensitive element of claim 21, wherein the dye consists essentially of an anionic dye containing an anionic sulfonate group.

25. The phosensitive element of claim 22, wherein the dye consists essentially of a heterocyclic mercapto compound.

* * * * *

UNITED STATES PATENT AND TRADEMARK OFFICE

CERTIFICATE OF CORRECTION

PATENT NO. : 5,188,926

DATED : February 23, 1993

INVENTOR(S) : Schofield et al.

It is certified that error appears in the above-indentified patent and that said Letters Patent is hereby corrected as shown below:

Column 1, line 37, change "oarbonamides" to --carbonamides--.

Column 1, line 37, change "oouplers" to --couplers--.

Column 1, line 49, insert --.-- after "couplers".

Column 4, the formula at line 47, add the reference character "A-XX".

Column 4, lines 60-61, change "Literatureiibersicht" to --Literaturiibersicht--.

Column 4, line 61, change "Mitteinlungen" to --Mitteilugen--.

Column 5, line 34, change "oarbon" to --carbon--.

Column 7, formula c-vii, that portion of the formula reading:

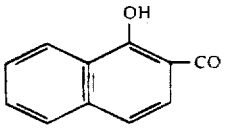

should read:

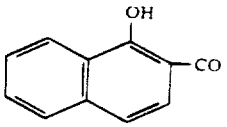

UNITED STATES PATENT AND TRADEMARK OFFICE

CERTIFICATE OF CORRECTION

PATENT NO. : 5,188,926

DATED : February 23, 1993

INVENTOR(S) : Schofield et al.

It is certified that error appears in the above-indentified patent and that said Letters Patent is hereby corrected as shown below:

Column 9, formula c-x, that portion of the formula reading:

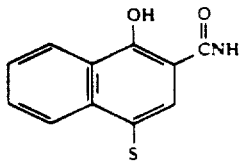

should read:

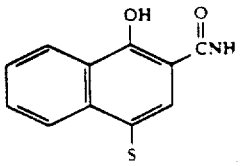

Column 14, line 60, change "Tien-The" to --Tien-Teh--.

Column 15, line 28, change "-" to --≥--.

Column 17, line 20, change "lest" to --least--.

Column 19, line 5, change "Photooraphy" to --Photography--.

Column 20, lines 11-12, change "perormance" to --performance--.

Column 20, line 12, change "chromatorgraphy" to --chromatography--.

Column 20, line 13, change "remining" to --remaining--.

Column 20, line 56, delete " n ".

UNITED STATES PATENT AND TRADEMARK OFFICE

CERTIFICATE OF CORRECTION

PATENT NO. : 5,188,926

DATED : February 23, 1993

INVENTOR(S) : Schofield et al.

It is certified that error appears in the above-identified patent and that said Letters Patent is hereby corrected as shown below:

Claim 1, column 22, line 25, change "aryloxcarbonyl" to --aryloxycarbonyl--.

Claim 9, column 23, line 52, change "aryloxcarbonyl" to --aryloxycarbonyl--.

Claim 9, column 23, line 58, change "straining" to --staining--.

Claim 12, column 24, line 17, delete "contains".

Claim 12, column 24, line 25, change "heterocylic" to --heterocyclic--.

Claim 16, column 24, line 59, change "aryloxcarbonyl" to --aryloxycarbonyl--.

Claim 16, column 24, line 62, change "aryloxcarbonyl" to --aryloxycarbonyl--.

Claim 21, column 26, line 6, change "aryloxcarbonyl" to --aryloxycarbonyl--.

Claim 21, column 26, line 11, change "joint" to --join--.

Signed and Sealed this

Nineteenth Day of April, 1994

Bruce Lehman

*Attest:*

BRUCE LEHMAN

*Attesting Officer*

*Commissioner of Patents and Trademarks*